US005093670A

United States Patent [19]

Braathen

[11] Patent Number: 5,093,670

[45] Date of Patent: Mar. 3, 1992

[54] LOGARITHMIC PERIODIC ANTENNA

[75] Inventor: Russell Braathen, Calgary, Canada

[73] Assignee: NovAtel Communications, Ltd., Calgary, Canada

[21] Appl. No.: 554,294

[22] Filed: Jul. 17, 1990

[51] Int. Cl.[5] ..... H01Q 11/10

[52] U.S. Cl. ..... 343/792.5; 343/795

[58] Field of Search ..... 343/792.5, 853, 810–812, 343/795, 700 MS File

[56] References Cited

U.S. PATENT DOCUMENTS

| | | | |
|---|---|---|---|
| 3,509,573 | 4/1970 | Balmain | 343/792.5 |
| 4,101,901 | 7/1978 | Kommrusch | 343/853 |
| 4,730,187 | 3/1988 | Menich et al. | 455/33 |

FOREIGN PATENT DOCUMENTS

| | | | |
|---|---|---|---|
| 34384 | 12/1964 | Fed. Rep. of Germany | 343/792.5 |

OTHER PUBLICATIONS

Kraus: Antennas, Second Edition McGraw-Hill; 703–710.

Balanis: Antenna Theory Analysis and Design, Harper & Row, 1982; New-York; 413–444.

Rudge et al.: The Handbook of Antenna Design vols. I and II, IEEE; 1986; London; 1393–1402 and 1461–1466.

*Primary Examiner*—Michael C. Wimer

*Attorney, Agent, or Firm*—Cesari & McKenna

[57] ABSTRACT

A logarithmic periodic antenna is constructed with antenna elements implanted in a single plane in or on a surface of an insulating substrate. The substrate supports the co-planar antenna elements and keeps them in the desired configuration. The antenna elements are arranged in pairs, with the elements of a given pair being on alternate sides of a center conductor. The center conductor consists of two conducting strips, or feeders, which run down the middle of the antenna structure. Each of the feeders connects to a different one of a pair of elements, and each feeder connects to alternating elements of consecutive pairs, for example, to the "left" element of one pair and the "right" element of the next pair. The logarithmic periodic antennas may be used, without signal degradation, as both transmitting and receiving antennas in split-frequency communications systems. These antennas, which have minimal back and side lobe amplitudes, may be configured in an array by being mounted on a single mast and at the same height.

5 Claims, 3 Drawing Sheets

LOGARITHMIC PERIODIC ANTENNA

FIELD OF INVENTION

This invention relates generally to antennas, and more particularly to antennas for use in split-frequency, or duplex, communication systems.

BACKGROUND

Cellular mobile communications systems include stationary sites, referred to as base stations, and subscriber units, such as car telephones or hand-held telephones. A base station receives signals from and transmits signals to subscriber units which should be within a predetermined radius of the station. A number of base stations typically service a given geographical area, for example, a city.

The base stations and subscriber units transmit and receive signals in full duplex mode. The base stations receive signals and simultaneously transmit signals over a frequency range which extends from 800 MHz to 900 MHz (900 MHz to 1000 MHz using UK standards). The range includes two bands, an upper band and a lower band, which are separated in the frequency spectrum by about 45 MHz. The base stations transmit signals and the subscriber units receive them in one band, and the subscriber units transmit signals and the base stations receive them in the other band. This allows the base stations and the subscriber units to separate the received and transmitted signals.

Two types of antennas typically used in base stations are co-linear arrays and corner reflectors. Both types of antenna are to some degree capable of operating over a broad frequency range. They are thus capable of operating simultaneously over the two cellular communications bands. For example, co-linear arrays are typically optimized for one of the bands, e.g. the transmit band, and operate in a degraded manner over the other one.

What is needed is an antenna which operates without degradation over the entire cellular communications frequency range, that is, over both the upper and the lower bands. The antenna must also be economical to produce, rugged enough to withstand climatic changes, and essentially maintenance free. If such an antenna is light-weight, also, it can be easily mounted at the base station and/or used at the subscriber units to extend the range of the unit.

SUMMARY OF INVENTION

The invention is an antenna which uses logarithmic periodic elements to receive and transmit communications signals. Logarithmic periodic antennas, also referred to as "log-periodic" antennas, are readily configured to maintain optimum gain over the entire cellular communications frequency range.

The antennas can be built using printed circuit technology. Antenna elements are implanted in or on a surface of an insulating substrate. They are arranged in pairs, with the elements of a pair being on alternate sides of a center conductor. The center conductor consists of two conducting strips, or feeders, which run down the middle of the antenna structure. One feeder, which is one "electrical side" of the conductor, connects to one element of each pair and the second feeder, which is a second electrical side, connects to the other element. A feeder connects to alternating elements of the pairs, for example, it connects to the "left" element of one pair and the "right" element of the next pair, and so forth.

The antenna elements are formed on the same plane within or on the substrate. Accordingly, the principle beam axis for each frequency is in the same direction. The substrate supports the co-planar antenna elements and keeps them in the desired configuration, making the antenna virtually impervious to climatic conditions. These antennas are thus better suited to cellular communications systems than are two-transmission-line style antennas made of metal rods. The elements of such metal rod antennas must be bent in order to make them co-planar, which makes the antenna particularly susceptible to wind damage.

A base station which services a circular area may utilize the log-periodic antennas as receiving antennas. The antennas are thus rigidly mounted in a circular array around the top of a center mast, with each antenna servicing a different sector of the base station's coverage area. With their minimal back and side lobe amplitudes, the antennas may be mounted on the same mast and at the same height. Such an array would replace the various corner reflector receiving antennas now used in base stations. The log periodic antennas may also be used, without signal degradation, as both transmitting and receiving antennas at base stations which service non-circular coverage areas, such as stations which service semi-circular or elliptical areas.

The log-periodic antennas are light-weight and rugged. The antennas are thus portable, and they can be used at subscriber units to increase the gain of units over what it is with standard dipole antennas. Accordingly, a subscriber unit in a remote area may communicate with a base station by orienting the log-periodic antenna in the direction of the base station and using the antenna to both transmit and receive cellular communication signals.

Log-periodic antennas are described in antenna design handbooks, for example, *Antenna Theory Analysis and Design* by Constantine Balanis; *Antennas,* 2nd Edition, by John D. Kraus; and the IEEE *Handbook of Antenna Design, Volumes* 1 *and* 2. A directional log-periodic antenna is typically designed as a "dipole array." The dimensions and spacings of the elements are logarithmically related to the frequency range over which the antenna is to operate. The antenna design handbooks set forth formulas which may be used to determine the particular dimensions and spacing parameters for a log-periodic antenna which is to operate over a given frequency range, such as the full cellular communications frequency range. The references, however, depict log-periodic antennas as configurations of hollow tubing or rods which are bent or cut to achieve desired frequency results. Such antennas are not normally used for cellular communications systems because they are not sufficiently rugged to stand up to adverse climatic conditions for long periods of time.

The inventive log-periodic antennas are easily formed on the dielectric substrates, which adds rigidity and longevity to the antennas and makes them highly suitable for use in cellular communication systems. In addition, the use of printed circuit technology allows the antennas to be made at a relatively low cost.

BRIEF DESCRIPTION OF THE DRAWINGS

The above and further advantages of the invention may be better understood by referring to the following description in conjunction with the accompanying drawings, in which.

DETAILED DESCRIPTION

Figure 1:
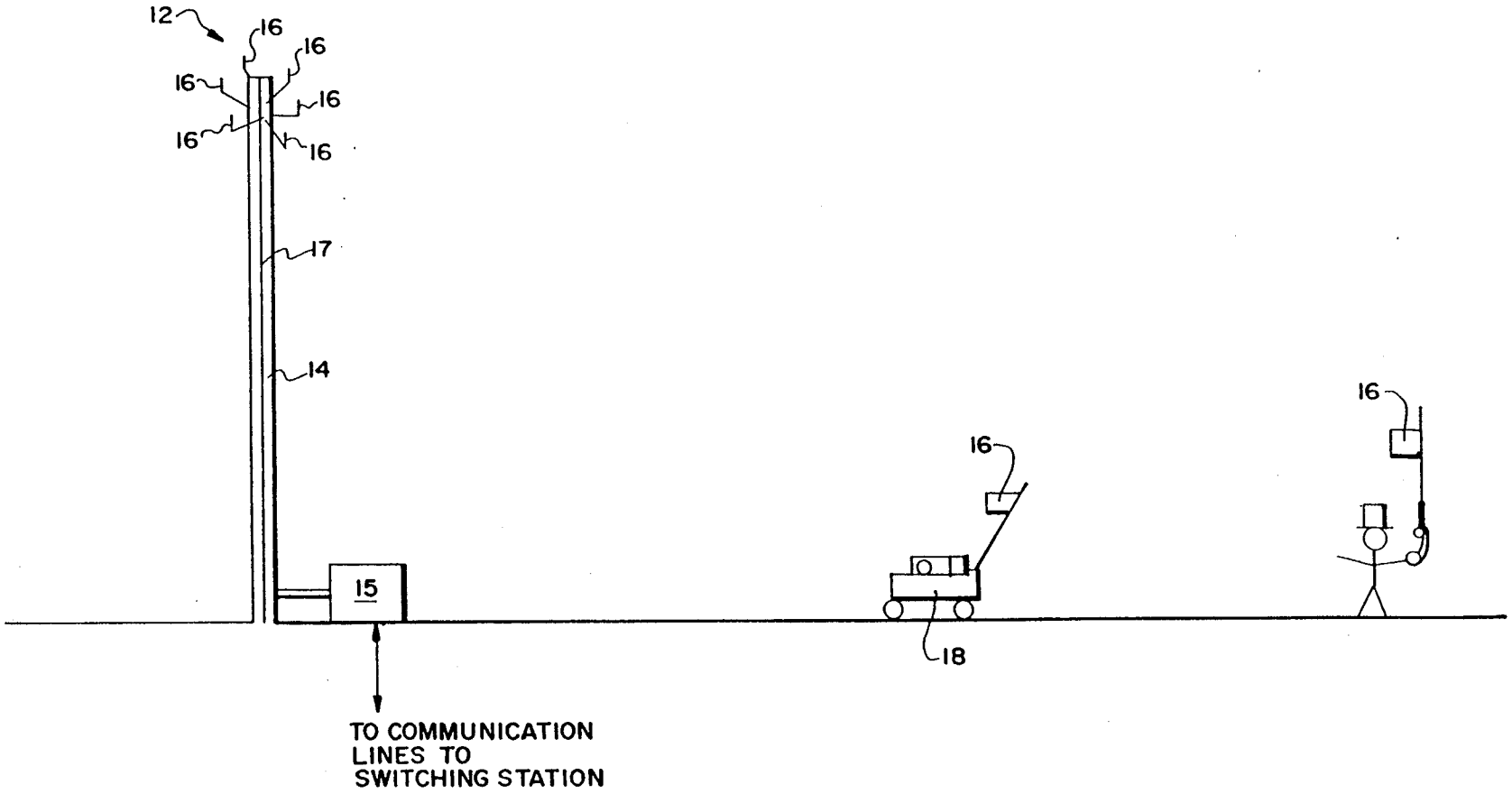
FIG. 1 is an illustration of a base station and associated subscriber units, all of which include antennas constructed in accordance with the current invention.

FIG. 1 depicts a base station 12 which consists of a mast 14, a controller 15, which includes transceivers, duplexers and other conventional circuitry for transmitting and receiving cellular communications signals, and a circular array of log-periodic antennas 16 mounted on the mast 14. The base station antennas 16 may be used to transmit signals to and receive signals from subscriber mobile units 18 and 20, illustratively a car telephone and a hand-held mobile telephone, respectively. The subscriber units transmit signals to and receive signals from the base station 12 using portable log-periodic antennas 16. The base station 12 and the subscriber units 18 and 20 operate in full duplex mode, and thus, each can simultaneously transmit and receive signals.

A base station 12 servicing a circular-shaped coverage area normally uses the circular array of antennas 16 to receive signals. It uses, to transmit signals, a vertical co-linear array (not shown). Base stations covering a non-circular coverage area may use the antennas 16 for both transmitting and receiving. The antennas 16 are arranged in arrays which are best suited for the shape of the coverage area, for example, semi-circular arrays.

Referring again to FIG. 1, a subscriber unit 18 communicates with another telephone, whether it is a subscriber telephone or a land line telephone, by transmitting signals over its portable antenna 16 to the base station 12. The subscriber unit transmits the signals in a frequency which is within one band of the cellular communications frequency range. The base station antenna 16 oriented in the direction of unit 18 receives the signals, and sends them along connected feed lines 17 which run down the mast 14 to transceivers and processors (not shown) which are part of the controller 15. The controller 15 further transmits the signals over communications lines to central communications processors (not shown) to which the base station 12 is connected.

The communications processors process the signals received from the base station 12 and transmit them over appropriate communications paths, for example, land telephone lines, to a destination telephone (not shown) which is specified by the unit 18. When the destination telephone has information to communicate to the unit 18, it transmits signals containing the information back over the communications paths to the base station 12. The base station controller 15 processes the signals and sends them along feeder lines 17 to the same antenna 16 or, if the unit has moved to a different sector, to another antenna 16 oriented in the direction of the subscriber unit. The station then transmits the signals to the subscriber unit in a frequency which is in the other band of the cellular communications range.

Figure 2:
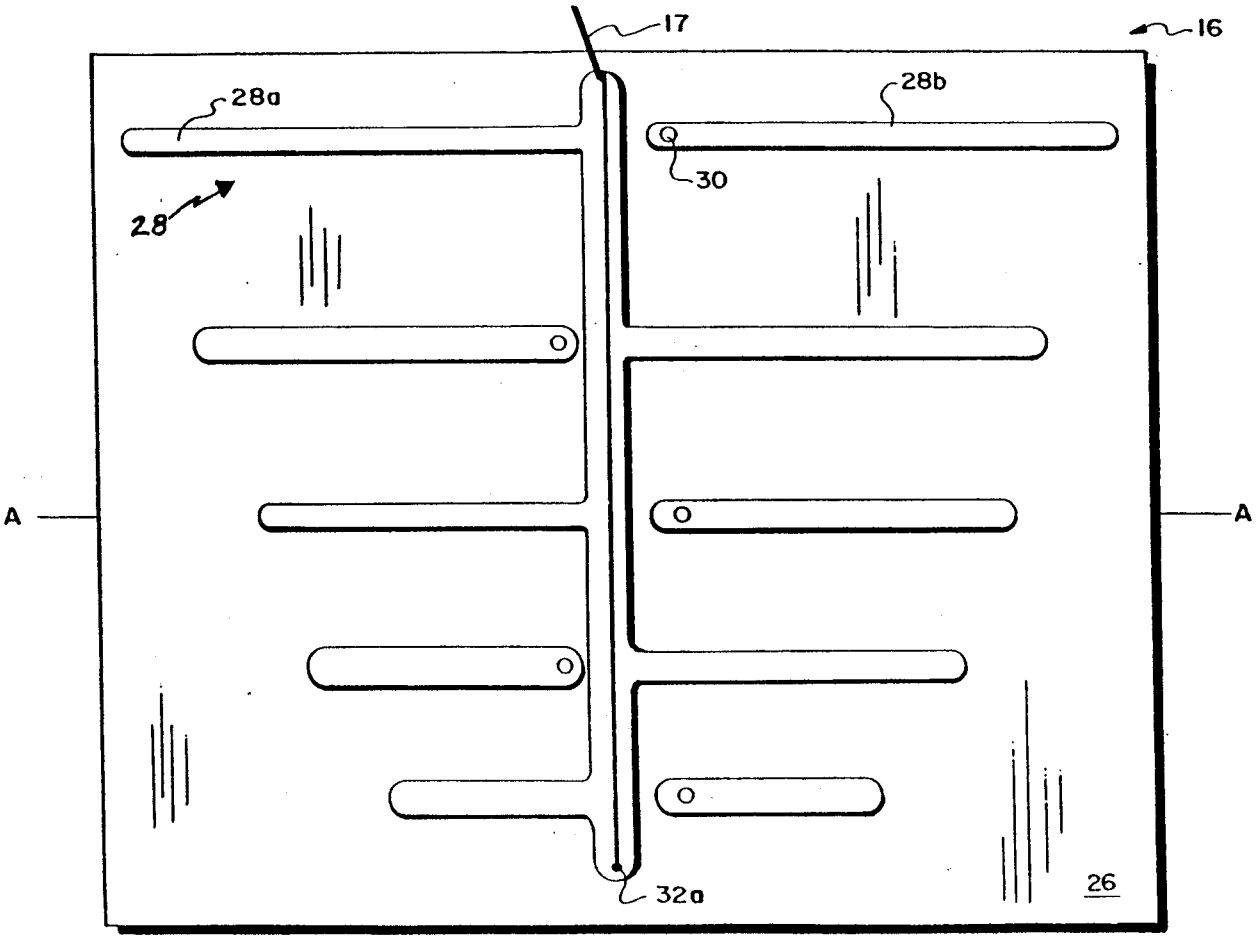
FIG. 2 is a diagram of the log-periodic antennas shown in FIG. 1.
Figure 3:
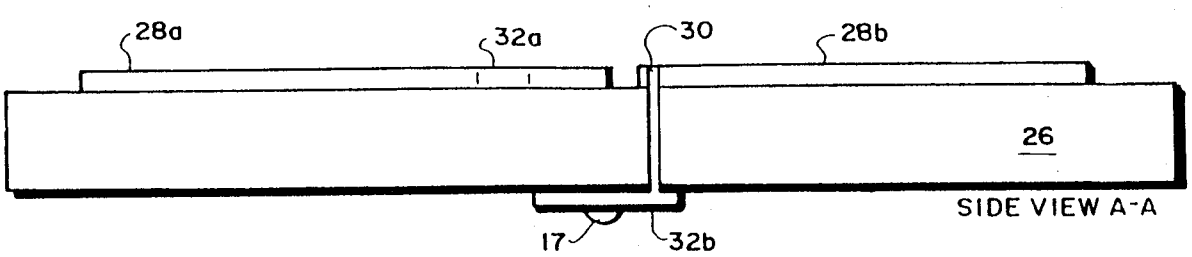
FIG. 3 is a side view of the log-periodic antenna shown in FIG. 2.

A log-periodic antenna 16 is shown in FIGS. 2 and 3. The antenna 16 consists of a dielectric substrate 26 which supports, on one plane, sequences of antenna element pairs 28*a* and 28*b*. The elements 28 are sized and spaced to operate over the entire cellular communications frequency range, and thus they correspond to the various formulas in the antenna design references cited earlier.

Since the antenna elements 28 are formed in the same plane, the principle beam axis for each frequency is in the same direction. Connecting strips, or feeders, 32*a* and 32*b* (FIG. 3) run down the middle of the antenna. These feeders may be embedded in the substrate or lay on its top and bottom surfaces. FIGS. 2 and 3 depict the feeders on the top and bottom surfaces of the substrate 26.

The feeders each connect to one element 28 of each element pair. The feeder 32*a* on the top surface of the substrate 26 connects directly to alternating elements of the pairs, that is, it connects to a left element of one pair and the right element of the next pair. Similarly, the second feeder 32*b* connects to alternating elements of the pairs using pins 30 which extend from the elements, through the substrate to the feeder, as shown in FIG. 3.

Figure 4:
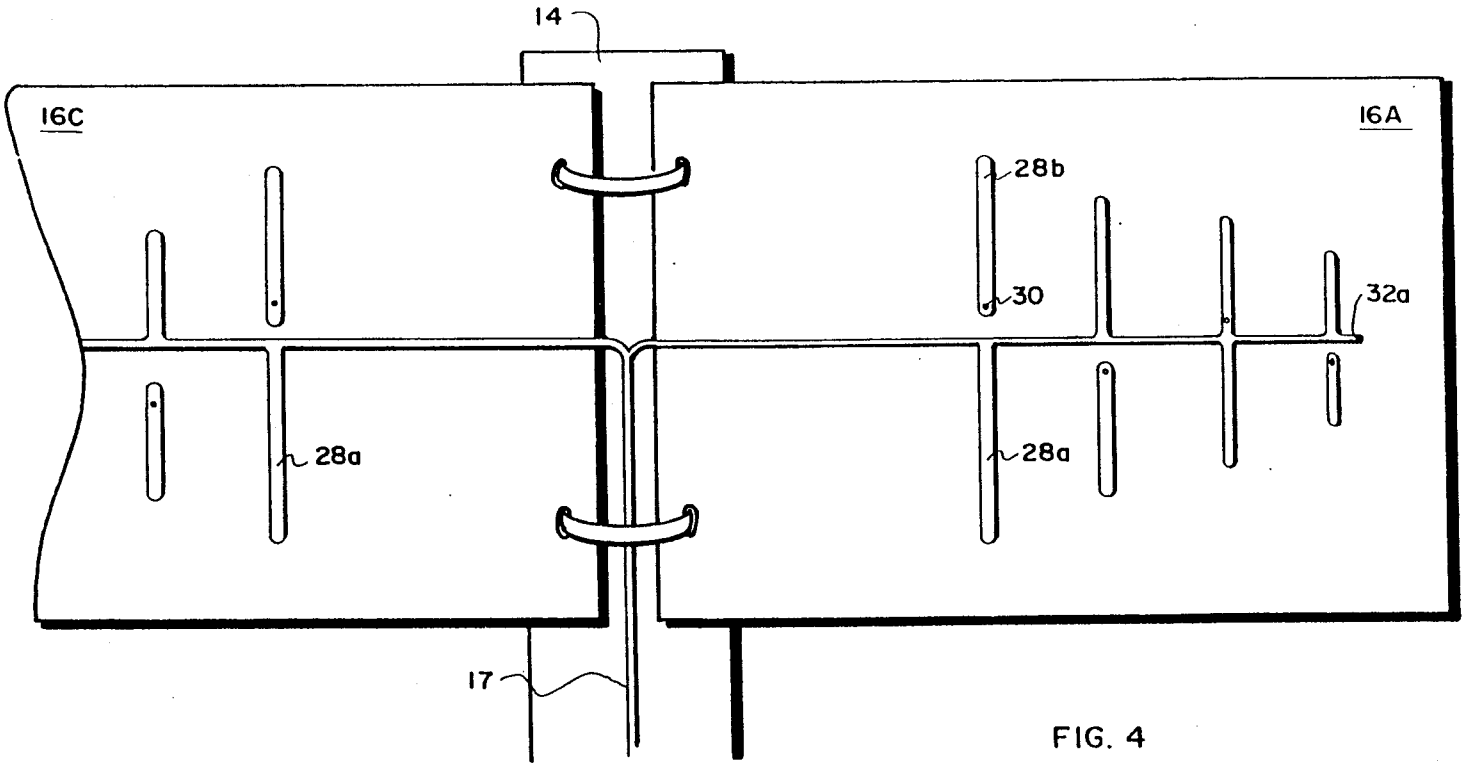
FIG. 4 is a diagram of an array of log-periodic antennas mounted for use in the base station shown in FIG. 1.

FIG. 4 illustrates one scheme for mounting the directional antennas 16 to form a multiple-sector array which is capable of servicing a circular area. The antennas 16 (with only 16*a* and 16*b* shown in FIG. 4) are mounted around the mast 14 at the same height. The antennas 16 are positioned such that they each service a predetermined portion, or sector, of the base station coverage area. Due to the minimal side-lobe and back-lobe amplitudes generally associated with log-periodic antennas, the antennas 16 may also be mounted directly on the mast 14 at the same height without adverse effects.

Each antenna 16 includes substrate 26 which extends beyond the antenna elements 28. The antennas 16 may be mounted to the mast 14 by mounting screws which are inserted through the extended end of the substrate into the mast 14. Alternatively, the antennas 16 may be placed in frames which are then mounted on the mast by conventional mounting brackets. The feed lines 17, which run through the mast 14 or down the side of it, are then extended from the mast 14 and connected, via coaxial cable, to the antenna feeders 32.

The inventive log-periodic antennas are formed on one plane of an insulating substrate using printed circuit technology. Antennas for use in base stations, that is, continuous outdoor use, may be covered with weatherproofing agents, for example, epoxy, for both protection from the weather and added rigidity. Individual antenna elements may be shaped to achieve desired frequency response characteristics. The shaped elements are not particularly susceptible to adverse climatic conditions, because they are rigidly supported by the substrate. This construction, which is an improvement over conventional metal rod constructions which are particularly susceptible to climatic damage, allows the antennas to be used in cellular communications systems. The inventive log-periodic antennas are essentially maintenance-free. Further, they are economical to produce using printed circuit technology.

The inventive antennas, in addition to being rugged and maintenance free, are also light weight and relatively small. Accordingly, a subscriber may carry an antenna with him when he is taking the unit 18 (FIG. 1) to remote areas in order to extend the range of the unit. The user points the portable antenna in the direction of the closest base station, and he can then transmit and receive signals with a signal gain of many more times that of the signals received and transmitted using a standard dipole antenna.

The antennas may be similarly used in any split-frequency, or duplex, communications system and is not limited to cellular communication systems.

The foregoing description has been limited to a specific embodiment of this invention. It will be apparent, however, that variations and modifications may be made to the invention, with the attainment of some or all of its advantages. Therefore, it is the object of the appended claims to cover all such variations and modifications as come within the true spirit and scope of the invention.

What is claimed is:

1. A logarithmic periodic antenna, said antenna including:

A. an insulating support structure;

B. a plurality of antenna elements, said antenna elements being arranged on one plane of said insulating support structure in an array consisting of a sequence of pairs of elements;

C. a pair of conducting strips with one of said strips being on said one plane and the other of said strips being on another plane of said insulating support structure, each of said conducting strips being connected to one of said antenna elements in each of said pairs of elements in said array.

2. The logarithmic periodic antenna of claim 1 wherein a portion of said insulating support structure extends beyond the antenna elements to facilitate mounting the antenna on a support, said antenna being mounted by attaching said portion of said insulating support structure which extends beyond the antenna elements directly to the support.

3. A two way split-frequency communication system, said system comprising:

A. signal processing circuitry;

B. an array of logarithmic periodic antennas for receiving signals and transmitting signals to and from said signal processing circuitry, said logarithmic periodic antennas being configured to operate over both a predetermined transmit frequency range and a predetermined receive frequency range, each of said logarithmic periodic antennas including i. an insulating support, ii. a plurality of antenna elements, said antenna elements being arranged on one plane of said insulating support in an array consisting of a sequence of pairs of elements, and iii. a pair of conducting strips with one of said strips being on one plane and the other of said strips being on another plane of said insulating support, each of said conducting strips being connected to one of said antenna elements in each of said pairs of elements in said array; and C. feed lines connecting said antennas to said signal processing circuitry;

and antennas receiving signals transmitted in a predetermined receive frequency range and sending them over said feed lines to said signal processing circuitry and simultaneously transmitting signals received from said feed line in a predetermined transmit frequency range.

4. The logarithmic periodic antenna of claim 3 wherein a portion of said insulating support extends beyond the antenna elements to facilitate mounting the antenna on a substantially vertical support, said antenna being mounted by attaching said portion of said insulating support which extends beyond the antenna elements directly to the substantially vertical support.

5. A mobile two way split-frequency communication unit, said mobile unit including a logarithmic periodic antenna which includes:

A. an insulating support;

B. a plurality of antenna elements, said antenna elements being arranged on one plane of said insulating support in an array consisting of a sequence of pairs of elements, said elements being dimensioned and spaced to operate over a cellular communications frequency range; and C. a pair of conducting strips with one of said strips being on one plane and the other of said strips being on another plane of said insulating support, each of said conducting strips being connected to one of said antenna elements in each of said pairs of elements in said array, said conducting strips connecting to signal processing circuitry in the mobile unit.

* * * * *